US006141939A

United States Patent [19]

Pedrotti et al.

[11] Patent Number: 6,141,939

[45] Date of Patent: Nov. 7, 2000

[54] APPARATUS FOR SEQUENTIALLY APPLYING PANELS OF PLASTIC CAPS TO GROUPS OF CANS OR JARS

[76] Inventors: Donatella Pedrotti; Chiara Pedrotti, both of Via Case Sparse, 12, 38060 Pomarolo, Italy

[21] Appl. No.: 09/105,013

[22] Filed: Jun. 26, 1998

[30] Foreign Application Priority Data

Jun. 30, 1997 [IT] Italy ..... VR97A0062

[51] Int. Cl.[7] ..... B65B 7/28

[52] U.S. Cl. ..... 53/48.1; 53/314; 53/316

[58] Field of Search ..... 53/48.1, 313, 314, 53/315, 316, 398

[56] References Cited

U.S. PATENT DOCUMENTS

| | | | |
|---|---|---|---|
| 1,445,296 | 2/1923 | Clark | 53/313 X |
| 3,460,314 | 8/1969 | Keas | 53/316 X |
| 3,760,554 | 9/1973 | Arneson | 53/398 |
| 3,867,807 | 2/1975 | Doucette | 53/48.1 |
| 4,098,058 | 7/1978 | Carrigan et al. . | |
| 4,231,209 | 11/1980 | Walker et al. | 53/48.1 |
| 4,896,480 | 1/1990 | Blumle | 53/316 X |

FOREIGN PATENT DOCUMENTS

| | | |
|---|---|---|
| 0 493 743 | 7/1992 | European Pat. Off. . |
| 97 215 91 | 6/1997 | WIPO . |

*Primary Examiner*—Linda Johnson
*Attorney, Agent, or Firm*—Guido Modiano; Albert Josif; Daniel J. O'Byrne

[57] ABSTRACT

An apparatus for sequentially applying panels or row of plastic caps to groups of cans or jars, which comprises: a feeding path for panels of caps, which is arranged above a belt conveyor arranged to feed a sequence of cans, already filled with product and sealed and belonging to a can packaging line; means for blocking each panel of caps at the end of the feeding path; and pressure means for applying each panel or row of caps to a group of cans being fed on the belt conveyor.

18 Claims, 4 Drawing Sheets

APPARATUS FOR SEQUENTIALLY APPLYING PANELS OF PLASTIC CAPS TO GROUPS OF CANS OR JARS

BACKGROUND OF THE INVENTION

The present invention relates to an apparatus for sequentially applying panels of plastic caps to groups of cans or jars and the like containing beverages such as beer, wine and alcohol-free beverages in general.

Plastic caps designed to cover a can or jar which contains a beverage have already been proposed mainly for the purpose of providing protection against dust or other foreign material at the upper part of the can, where the user will place his lips to drink.

SUMMARY OF THE INVENTION

The main object of the present invention is to provide a simple and effective solution to the above problem.

Another object of the present invention is to provide an apparatus for sequentially applying panels of caps to groups of cans which can be used in a packaging line for cans or jars to perform a specific function, i.e., that of applying a protective cover on the top of each can.

Another object of the present invention is to provide an apparatus as above which is simple in structure and reliable in operation.

This and further objects which will become better apparent hereinafter are achieved by an apparatus for sequentially applying panels of plastic caps to groups of cans or jars, which comprises: a feeding path for panels of caps, which is arranged above a belt conveyor, arranged to feed a sequence of cans, already filled with product and sealed, and belonging to a can packaging line; means for stopping each panel of caps at the end of the feeding path; and pressure means for applying each panel to a group of cans being fed on said belt conveyor.

Advantageously, the said feeding path for cap panels is a gravity path along an inclined plane.

BRIEF DESCRIPTION OF THE DRAWINGS

Further aspects and advantages of the present invention will become better apparent from the following detailed description of some currently preferred embodiments thereof, given merely by way of non-limitative examples with reference to the accompanying drawings, wherein.

In the accompanying drawings, identical or similar parts or components have been designated by the same reference numerals.

DESCRIPTION OF THE PREFERRED EMBODIMENTS

Figure 1:
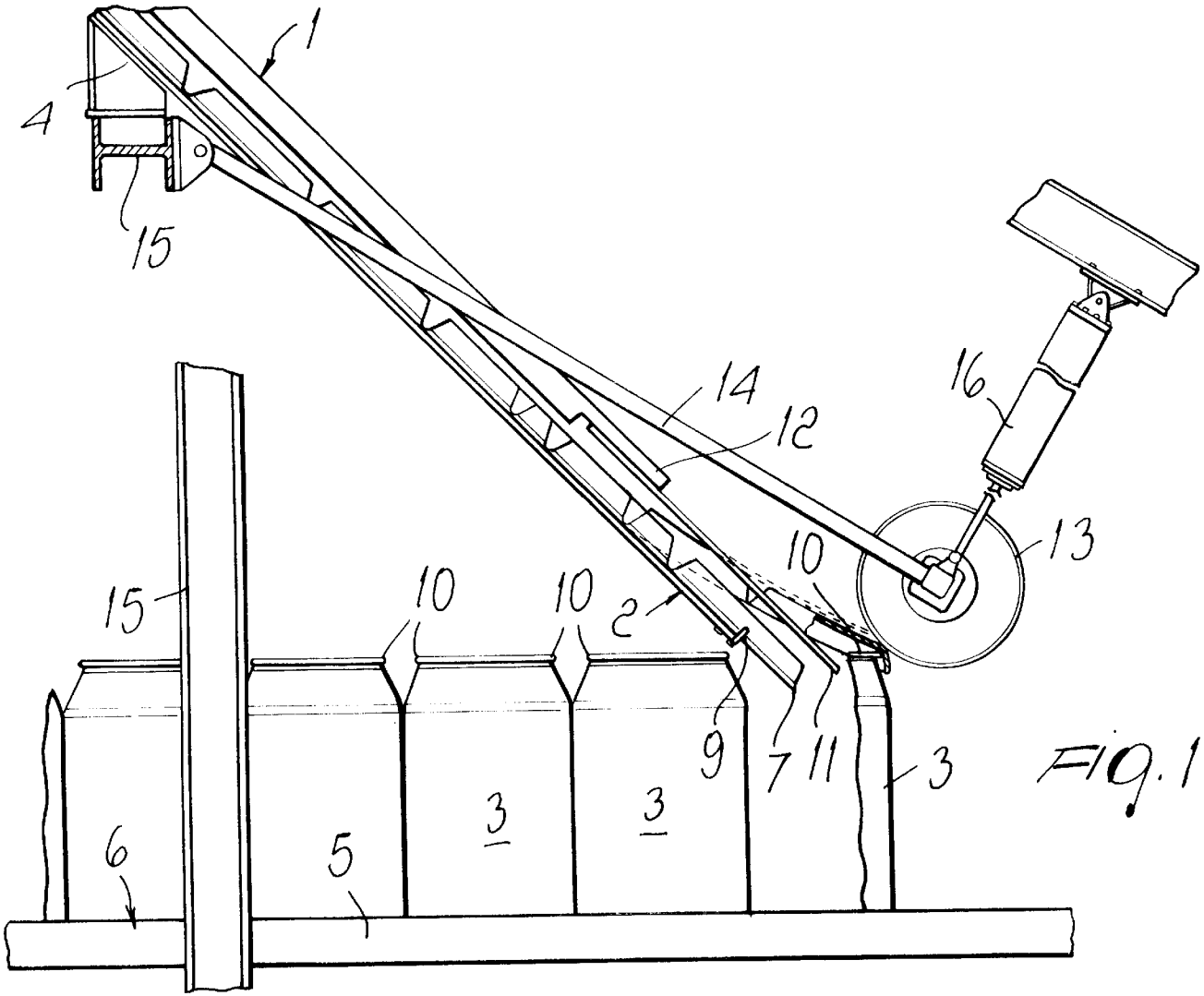
FIG. 1 is a diagrammatic front elevation view of a portion of a packaging line, including a belt conveyor and of a first embodiment of an apparatus according to the invention.

With reference to the above Figures, it will be noted that an apparatus 1 for sequentially applying panels 2 of plastic caps to groups of cans or jars 3 is constituted by a path 4 for feeding panels 2 of caps which lies above a belt conveyor 5 arranged to feed rows or orderly groups of cans 3, which have already been filled with product and sealed, and belonging a can packaging line, generally designated by the reference numeral 6. Typically, each ordered group or panel of cans comprises twenty-four (4×6) cans arranged side by side in a rectangular pattern, i.e., aligned both in the feeding and transverse directions along lines at right angles and thus, not in a quincuncial arrangement.

Accordingly, each panel 2 of caps comprises a number of caps 7, preferably made of transparent plastic, which is equal in number to the cans of each group 3 with which the panel is designed to engage from above. The caps have the same arrangement as the cans, i.e., they form a matrix in which their centers are aligned along rows and columns which cross at right angles with one another. The various caps 7 are mutually connected and held together by burr or radial tabs 8 which can be easily broken.

Preferably, the feeding path 4 of the panels of caps 2 is an inclined-plane sliding track, along which the panels 2 of caps advance in a controlled manner due to gravity one after the other.

Figure 2:
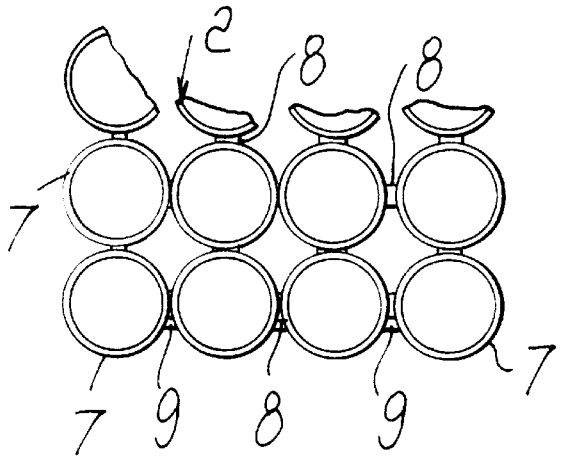
FIG. 2 is a front view of a panel of caps engaged by the stopping means at the end of the feeding path.
Figure 3:
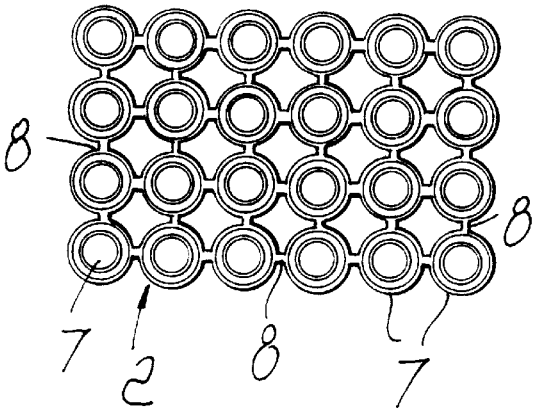
FIGS. 3 and 4 are, respectively, a plan view and a side view of a panel of caps.
Figure 4:
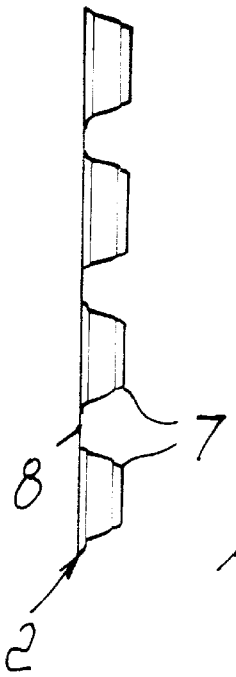
Figure 5:
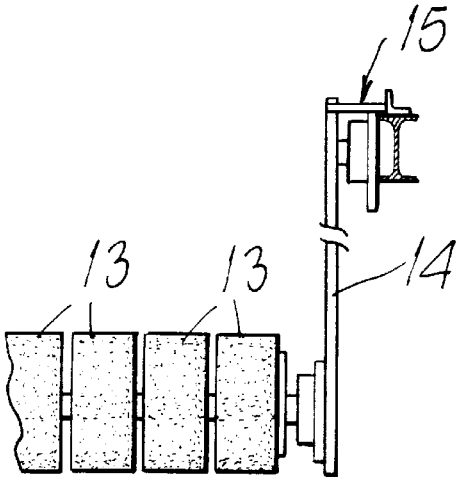
FIG. 5 is a reduced-scale top view of a detail of FIG. 1.

At the end of the descent path 4 stopping means are provided which are designed to stop each panel of caps 2 and comprise, for example, one or more hooks 9 which are directed toward the path 4 and are arranged to act as abutment elements for a respective tab 8 between two front caps of each panel 2 (FIG. 2). The hooks 9 cause each panel to stop at such a height above a group of cans 3 being fed along the belt conveyor 5 that the edges of the caps 7 arranged along the lower front of the respective panel 2 reach a level which is distinctly lower than the top rim 10 of the cans 3 (FIG. 1).

The feeding path 4 also has, in its lower end part, a flat spring 11 made of spring steel for each column of caps 7; said spring projecting out longitudinally and parallel above the lower or front part of the lowest panel 2 and is, for example, supported by a cross-member 12 in cantilevered fashion.

In a more advanced position in the direction of the movement of the cans 3 on the conveyor 5 with respect to the flat spring 11, pressure means are provided which comprise a transverse roller 13 freely rotatable about a horizontal axis, or a plurality of rollers which are mounted freely to rotate on the same axis and equal in number to the columns of caps 7. The roller or rollers 13 is or are supported, e.g., at an end of two cantilevered arms 14, the other end of which is secured to a supporting frame 15.

Advantageously, instead of the roller or rollers 13 one or more elastically flexible pressers can be provided which have a low friction coefficient for the caps 7.

Preferably, the roller or rollers 13 are spring-loaded by a pair of dampers or springs 16 arranged to keep the roller or rollers 13 resiliently pressed downwards.

The operation of the above-described apparatus is quite simple.

Panels 2 are loaded, one after the other, at the top of the feeding path 4. This operation can be performed by any suitable feeder, e.g. a sucker-fitted feeder arm, which picks up the panels 2 from a stack and transfers them in sequence to the path 4. The panels 2 slide sequentially down the inclined-plane path 4 until they abut against the hooks 9.

At the same time, groups of seamed and sealed cans 3, equal to, and being arranged as, the caps 7 in the panels, are moved forwards by the belt conveyor 5. The various groups of cans 3, if desired, can be supported by respective trays, e.g. made of cardboard, as is well known in the art.

The front row of each group of cans 3 passes below and to the side of the hooks 9 but abuts, with its upper edge 17, against the inner conical wall of a respective front cap 7 of the overlying panel retained by the hooks 9 and, whilst advancing on the conveyor 5, it pulls along the panel 2 in contrast with the thrust of the flat spring or springs 11 which assists or assist in ensuring and maintaining the rim 10 of the cans 3 in good mutual engagement with the caps 7, as shown in FIG. 1. As the assembly formed by the group of cans 3 and by the respective panel 2 is moved forward by the conveyor 5, it passes progressively below the roller or rollers 13, where the panel 2 is gradually applied, row by row, on all the cans so that each can is engaged by snap action by a respective cap 7.

The pack of cans each of which is now provided with a cap is then moved forward towards possible processing or handling stations provided in the packaging plant.

FIGS. 6 to 9 illustrate another embodiment of the apparatus according to the invention, in which the feeding path 4 has a first upper straight portion 4*a* shaped as an inclined plane, along which the panels of caps 2 can slide with their outer top 7*a* having only rounded parts and as such generate less friction, and a second lower portion 4*b* which is arc-like and along which the panels turn over so as to arrive above the cans 3 with their concavity arranged downwards.

The path 4*a* has, at its lower end, a stopping or blocking device 20 having one or more retention pawls 21 which are keyed on a horizontal shaft 22 which is mounted for rotation on fixed lateral supports 23. Therefore the, or each retention pawl 21 can be rotated between a working position, in which it can stop or block a panel of caps 2 moving along the path 4*a* by abutting against a respective tab 8 between two adjacent caps 7, and an inoperative position out of the path 4*a*.

The pawls 21 can be actuated upon control by a fluid-operated jack 24 which is pivoted both at its piston rod and cylinder and is actuated by a control unit, not shown in the drawings, or by any other suitable actuation means.

Figure 9:
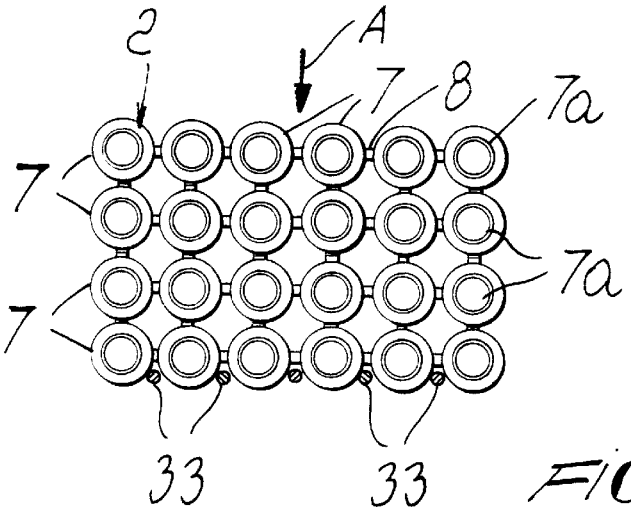
FIG. 9 is a view of a panel of caps, temporarily retained while waiting for the arrival of a front of cans.

On the opposite side with respect to the stopping device 20 there is also provided a set of guillotine blades 25 which are aligned transversely to the path 4*a* and are spaced by a pitch which is equal to the pitch of the caps 7 of the panels of caps 2. The blades 25 are designed to selectively cut, according to a program, tabs 8 of preset transverse rows of tabs, for example as shown in FIG. 9.

Each blade 25 is connected to a suitable actuation means, e.g. a fluid-operated jack 26 which is fixed to a bridge-like support, generally designated by the reference numeral 27, and is energized by the control unit.

Along the path 4*a*, the panels of caps 2 are preferably sterilized by means of sterilization units of any suitable kind, designated by the reference numeral 28.

Once each panel 2 has arrived at the end of the path 4*b* with the concave portion of the caps 7 facing downwards, it strikes from below one or more resilient laminae 29 (FIG. 6), which are supported in a cantilevered manner by a transverse shaft 30 by means of an adjustment screw 32.

Moreover the said panel is engaged by a plurality of pins 33, possibly provided with a blade-like tip 34, which are supported, in mutually spaced relationship by a rotatable transverse shaft 35 which is spring-loaded by one or more return springs 36. Each pin 33 is held in the position shown in FIG. 6 by the spring or springs 36, so as to abut against a respective front tab 8 of a panel 2 (FIG. 9).

As soon as a row of cans 3, the top of which has been preferably sterilized in any suitable manner, moves in the direction indicated by the arrow B (FIG. 6) under the front caps 7 of the panel 2 retained by the pins 33, the said cans engage from the inside the caps 7 and cause the entire panel to pass below the roller or rollers 13, while overcoming the force of the springs 36 and forcing the pins 33 to rise.

Said pins, if provided with a sharp blade-like tip 34, then (selectively) cut the longitudinal tabs 8 so as to separate each individual cap 7 or groups of caps 7 from the remaining caps in each panel according to a preset program.

Figure 6:
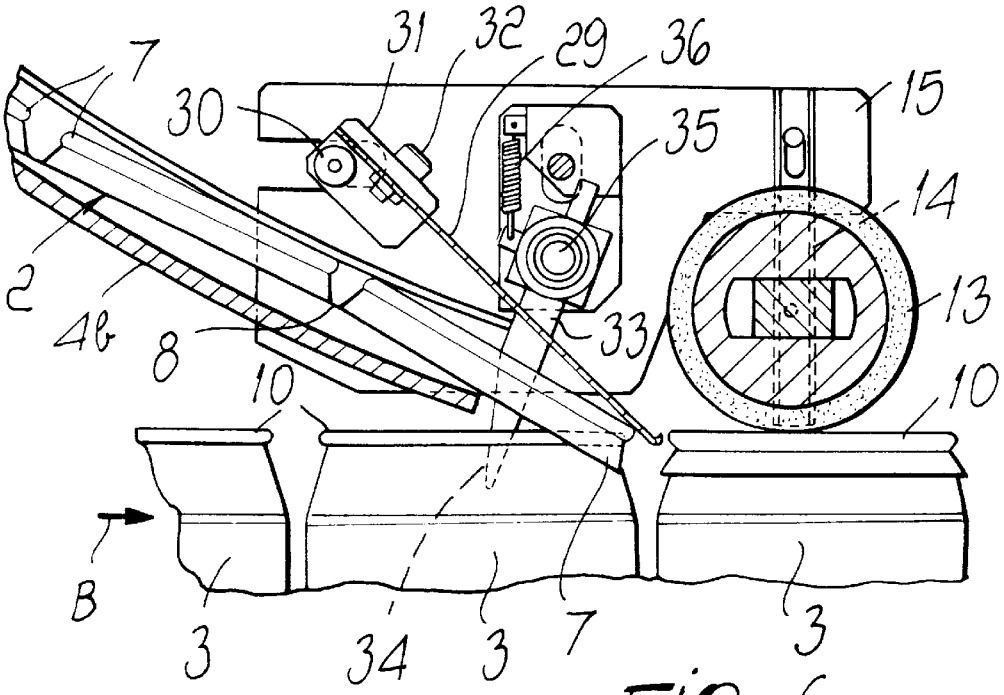
FIG. 6 is a partial diagrammatic side elevation perspective view of another embodiment of the apparatus according to the invention.
Figure 7:
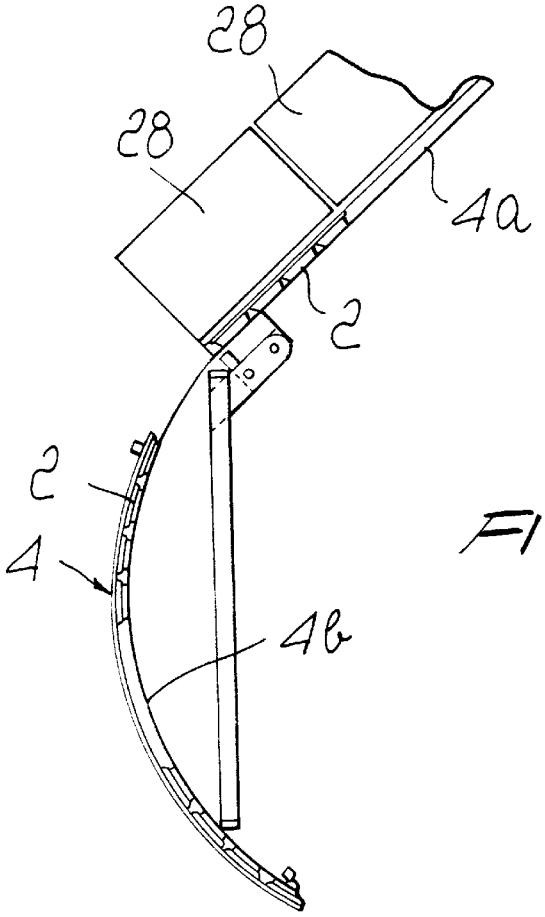
FIG. 7 is a reduced-scale view of a chute for feeding panels of caps to the apparatus of FIG. 6.
Figure 8:
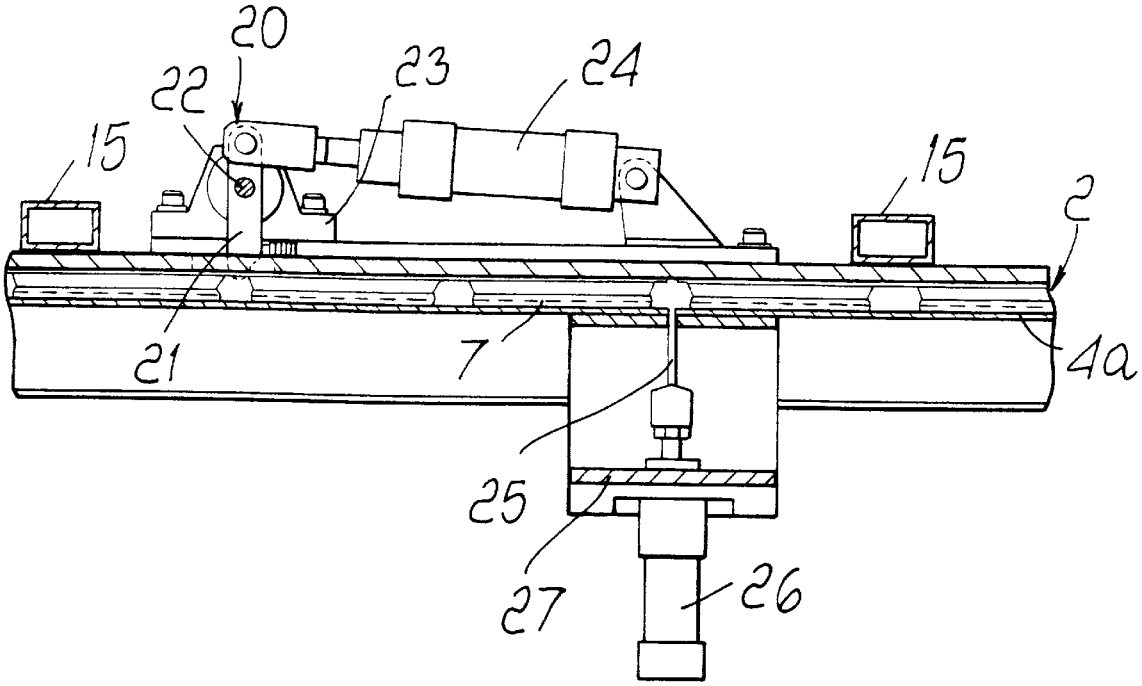
FIG. 8 is an enlarged-scale view of a detail of the chute of FIG. 7.

Once a panel or a row of caps has passed under the pins 33 and the last row of tabs 8 has been possibly cut, the pins 33 are immediately caused to return to their stopping position of FIG. 6 to stop and/or temporarily retain the next panel or row of caps.

It will be noted that the apparatus according to the present invention can be easily adapted to can packaging plants without requiring modifications in the working cycle of the plant.

The above described apparatus is susceptible to numerous modifications and variations within the scope of the appended claims.

What is claimed is:

1. An apparatus for sequentially applying panels composed by a plurality of interconnected plastic caps to upwardly open containers placed in a group arrangement, each panel including at least one row of caps arranged so as to correspond to the group arrangement of said containers, said caps being connected to each other by radial tabs, the apparatus comprising:

a belt conveyor for feeding in sequence group arrangements of containers already filled with product and sealed; a feeding path for feeding said cap panels above said belt conveyor;

stopping means for stopping each cap panel at an end region of said feeding path, said stopping means comprising at least one abutment element arranged along said feeding path so as to abut at said radial tabs without interfering with said caps; and pressure means, arranged at said belt conveyor downstream of said end region of said feeding path, for pressing down successive rows of caps so as to apply the caps to the containers placed in the group arrangement fed on said belt conveyor.

2. The apparatus of claim 1, wherein said feeding path is a gravity sliding track along an inclined plane.

3. The apparatus of claim 1, wherein said feeding path comprises an upper straight portion, which is shaped like an inclined plane and along which said cap panels slidingly move rested at outer top areas thereof, and a curved lower portion, along which the said cap panels move so as to turn over with cap concavities directed downwards.

4. The apparatus of claim 3, wherein said upper path comprises initial stopping means which are arranged to stop, upon control, the said cap panels in a preset position.

5. The apparatus of claim 4, wherein the said initial stopping means comprise at least one stop pawl movable between a working position, for stopping a cap panel, and an inoperative position out of said upper path, and actuation means for said at least one pawl.

6. The apparatus of claim 3, further comprising: a plurality of cutting means which are aligned transversely to said upper path and are arranged to selectively cut and sever preset rows of caps of the cap panels moving along said path; actuation means for each cutting means; and a control unit for controlling said actuation means.

7. The apparatus of claim 1, comprising sterilization means for sterilizing said cap panels, said sterilization means being arranged along said feeding path.

8. The apparatus of claim 2, wherein said at least one abutment element is arranged so as to abut at a tab connecting two front caps of each cap panel, to stop descent of the cap panel at such a height, above a group of containers being fed on the said conveyor, that edges of the containers running along a lower front of the cap panel are at a lower level than a top rim of the containers.

9. The apparatus of claim 8, wherein the said at least one abutment element comprises a hook-like element facing towards said feeding path.

10. The apparatus of claim 8, wherein said at least one abutment element comprises a plurality of spaced pins, a rotating transverse support shaft for carrying a first end of said pins, and at least one resilient loading means for said shaft.

11. The apparatus of claim 10, wherein at least one of said spaced pins has a second end thereof shaped like a sharp blade, to sever a row of caps of a cap panel pulled by containers fed by said conveyor.

12. The apparatus of claim 1, wherein said pressure means comprise, at said end region of the feeding path, at least one flat spring which projects longitudinally parallel to and above an edge portion of said path to resiliently press each said cap panel coming out from said path.

13. The apparatus of claim 12, wherein said pressure means comprise at least one roller, located downstream of said feeding path, and mounted to rotate freely about an axis thereof located transversally to said feeding path.

14. The apparatus of claim 13, wherein said at least one roller is located further downstream, along a movement direction of said conveyor, than the said flat spring.

15. the apparatus of claim 13, wherein said at least one roller is elastically loaded by a pair of any biasing elements being any of dampers and springs, said biasing elements being arranged to keep said at least one roller yieldably pressed towards said belt conveyor.

16. The apparatus of claim 1, wherein said pressure means comprise at least one resiliently yieldable member with a low friction coefficient arranged to act on each said cap panel.

17. An apparatus for sequentially applying panels composed by a plurality of interconnected plastic caps to upwardly open containers placed in a group arrangement, each panel including at least one row of caps arranged so as to correspond to the group arrangement of said containers, said caps being connected to each other by radial tabs, the apparatus comprising:

a belt conveyor for feeding in sequence group arrangements of containers already filled with product and sealed;

a feeding path for feeding said cap panels above said belt conveyor;

stopping means for stopping each cap panel at an end region of said feeding path, said stopping means comprising a plurality of spaced pins arranged along said feeding path so as to abut at said radial tabs without interfering with said caps;

cutting means for selectively cutting said radial tabs so as to separate selected caps from the cap panel located at the end region of the feeding path, said cutting means being constituted by blade shaped tips provided at respective ends of said spaced pins; and pressure means, arranged at said belt conveyor downstream of said end region of said feeding path, for pressing down successive rows of caps so as to apply the caps to the containers placed in the group arrangement fed on said belt conveyor.

18. An apparatus for sequentially applying panels composed by a plurality of interconnected plastic caps to upwardly open containers placed in a group arrangement, each panel including at least one row of caps arranged so as to correspond to the group arrangement of said containers, said caps being connected to each other by radial tabs, the apparatus comprising:

a belt conveyor for feeding in sequence group arrangements of containers already filled with product and sealed;

a feeding path for feeding said cap panels in a feeding direction above said belt conveyor, said feeding path including a first initial portion, and a second final portion arranged downstream with respect to said first portion along the feeding direction of said cap panels;

initial stopping means for stopping each cap panel in a preset position at said feeding path initial portion, said initial stopping means comprising retention elements engageable in abutment with said radial tabs without interfering with the caps;

transversal cutting means aligned transversally to said feeding path initial portion for selectively cutting tabs connecting transverse rows of caps;

stopping means for stopping each cap panel at an end region of said feeding path, said stopping means comprising a plurality of spaced pins arranged along said feeding path so as to abut at said radial tabs without interfering with said caps;

cutting means for selectively cutting said radial tabs so as to separate selected caps from the cap panel located at the end region of the feeding path, said cutting means being constituted by blade shaped tips provided at respective ends of said spaced pins; and pressure means, arranged at said belt conveyor downstream of said end region of said feeding path, for pressing down successive rows of caps so as to apply the caps to the containers placed in the group arrangement fed on said belt conveyor.

* * * * *